US007647950B2

(12) United States Patent
Clüsserath

(10) Patent No.: US 7,647,950 B2
(45) Date of Patent: Jan. 19, 2010

(54) BEVERAGE BOTTLING PLANT WITH A BEVERAGE BOTTLE FILLING MACHINE FOR FILLING BEVERAGE BOTTLES, AND FILLING ELEMENTS FOR THE BEVERAGE BOTTLE FILLING MACHINE

(75) Inventor: Ludwig Clüsserath, Bad Kreuznach (DE)

(73) Assignee: KHS Maschinen- und Anlagenbau AG, Dortmund (DE)

( * ) Notice: Subject to any disclaimer, the term of this patent is extended or adjusted under 35 U.S.C. 154(b) by 504 days.

(21) Appl. No.: 11/451,127

(22) Filed: Jun. 12, 2006

(65) Prior Publication Data

US 2007/0006939 A1 Jan. 11, 2007

Related U.S. Application Data

(63) Continuation-in-part of application No. PCT/EP2004/014088, filed on Dec. 10, 2004.

(30) Foreign Application Priority Data

Dec. 13, 2003 (DE) ..... 103 59 492

(51) Int. Cl.
*B65B 31/00* (2006.01)

(52) U.S. Cl. ..... 141/56; 141/44; 141/48; 141/51; 141/54; 141/57

(58) Field of Classification Search ..... 141/4–7, 141/39, 40, 44–50, 54, 56, 57, 59, 63, 285, 141/293, 302, 305, 307; 53/268, 276
See application file for complete search history.

(56) References Cited

U.S. PATENT DOCUMENTS

| | | | | |
|---|---|---|---|---|
| 4,644,981 | A | 2/1987 | Bernhard | |
| 5,501,253 | A * | 3/1996 | Weiss | 141/40 |
| 5,634,500 | A * | 6/1997 | Clusserath et al. | 141/48 |
| 6,189,578 | B1 * | 2/2001 | Clusserath | 141/7 |
| 6,470,922 | B2 * | 10/2002 | Sindermann | 141/37 |
| 6,817,386 | B2 * | 11/2004 | Tsukano et al. | 141/57 |
| 7,353,848 | B2 * | 4/2008 | Krulitsch | 141/56 |
| 7,469,726 | B2 * | 12/2008 | Clusserath et al. | 141/57 |
| 2002/0139434 | A1 | 10/2002 | Meheen | |

FOREIGN PATENT DOCUMENTS

| | | |
|---|---|---|
| DE | 41 17 287 | 12/1992 |
| DE | 41 34 446 | 4/1993 |
| DE | 43 24 592 | 1/1995 |
| DE | 4402980 C1 | 6/1995 |
| DE | 198 18 761 | 10/1999 |
| DE | 198 36 500 | 2/2000 |
| DE | 19939521 A1 | 9/2000 |
| DE | 100 00 793 | 8/2001 |
| RU | 2031082 | 3/1995 |

* cited by examiner

*Primary Examiner*—Timothy L Maust
(74) *Attorney, Agent, or Firm*—Nils H. Ljungman & Associates

(57) ABSTRACT

A beverage bottling plant with a beverage bottle filling machine for filling beverage bottles, as well as the filling elements for the beverage bottle filling machine.

20 Claims, 6 Drawing Sheets

BEVERAGE BOTTLING PLANT WITH A BEVERAGE BOTTLE FILLING MACHINE FOR FILLING BEVERAGE BOTTLES, AND FILLING ELEMENTS FOR THE BEVERAGE BOTTLE FILLING MACHINE

CONTINUING APPLICATION DATA

This application is a Continuation-In-Part application of International Patent Application No. PCT/EP2004/014088, filed on Dec. 10, 2004, which claims priority from Federal Republic of Germany Patent Application No. 103 59 492.2, filed on Dec. 13, 2003. International Patent Application No. PCT/EP2004/014088 was pending as of the filing date of this application. The United States was an elected state in International Patent Application No. PCT/EP2004/014088.

BACKGROUND

1. Technical Field

This application relates to a beverage bottling plant with a beverage bottle filling machine for filling beverage bottles, as well as the filling elements for the beverage bottle filling machine. This application further relates to a filling element for a filling machine for filling a liquid product, such as a beverage, for example, under counterpressure in bottles, cans or similar containers, with a liquid duct that has a controllable liquid valve and ends in a product dispensing opening, with at least one first controlled gas path, by means of which the interior of the individual container that is attached to the filling element can be connected for an evacuation with a vacuum duct of the filling machine, in which there is also a controlled pressure relief of the container after its filling under counterpressure. This application also relates to a filling machine employing a rotary construction for filling a product in bottles, cans or similar containers under counterpressure and with a subsequent pressure relief to ambient pressure, with a plurality of filling elements on a rotor that can be driven so that it rotates around a vertical machine axis.

2. Background Information

A wide variety of types of filling elements are used in filling machines in beverage bottling or container filling plants for dispensing a liquid product into bottles, cans or similar containers, including but not limited to filling processes that are carried out under counterpressure for the bottling of carbonated beverages.

OBJECT OR OBJECTS

The object of at least one possible embodiment is to create a filling element for a filling or bottling process that is conducted under counterpressure, and which makes possible a simplified construction of a filling machine while promoting or essentially guaranteeing a high level of operational safety and reliability.

SUMMARY

The application teaches a filling element for a filling machine for filling a liquid product, such as a beverage, for example, under counterpressure in bottles, cans or similar containers, with a liquid duct that has a controllable liquid valve and ends in a product dispensing opening, with at least one first controlled gas path, by means of which the interior of the individual container that is attached to the filling element can be connected for an evacuation with a vacuum duct of the filling machine, in which there is also a controlled pressure relief of the container after its filling under counterpressure, wherein for the pressure relief, a second controlled gas path that connects the interior of the container with the vacuum duct is provided with at least one element that reduces and/or regulates the flow in said gas path. The application also teaches a filling machine employing a rotary construction for filling a product in bottles, cans or similar containers under counterpressure and with a subsequent pressure relief to ambient pressure, with a plurality of the filling elements described herein on a rotor that can be driven so that it rotates around a vertical machine axis.

One feature of at least one possible embodiment is that the pressure relief of the individual container that is filled under counterpressure can take place after the termination of the filling phase via a controlled gas path, i.e. via a gas path with a control valve, into a vacuum duct, and specifically an element that reduces and/or regulates the gas flow during the pressure relief, for example via a nozzle and/or a deadweight safety valve and/or a spring-loaded valve and/or an open-loop or closed-loop gas flow control valve.

By controlling the flow of gas by reducing or regulating the flow, the pressure in the container or bottle can be controlled and thus the bubbling up of the effervescing gas in the carbonated beverage can be minimized. If the pressure is not controlled, the carbonated beverage could possibly bubble up quickly and forcefully, thereby resulting in spillage of beverage into and onto the components of the filling elements, and possibly onto the exterior of the bottles and/or the filling machine, and even possibly onto other machinery in the bottling plant or the floor of the plant. Such spillage is clearly undesirable because it results in wasted beverage product and dirty bottles which must be cleaned or discarded. Such spillage also results in increased frequency of cleaning of the bottling plant machinery and components, which increases the overall costs of operating the bottling plant.

Further developments of the above embodiments and other possible embodiments are described herein. The embodiments are explained in greater detail below with reference to the exemplary embodiments that are illustrated in the accompanying figures.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

DESCRIPTION OF EMBODIMENT OR EMBODIMENTS

Figure 1:
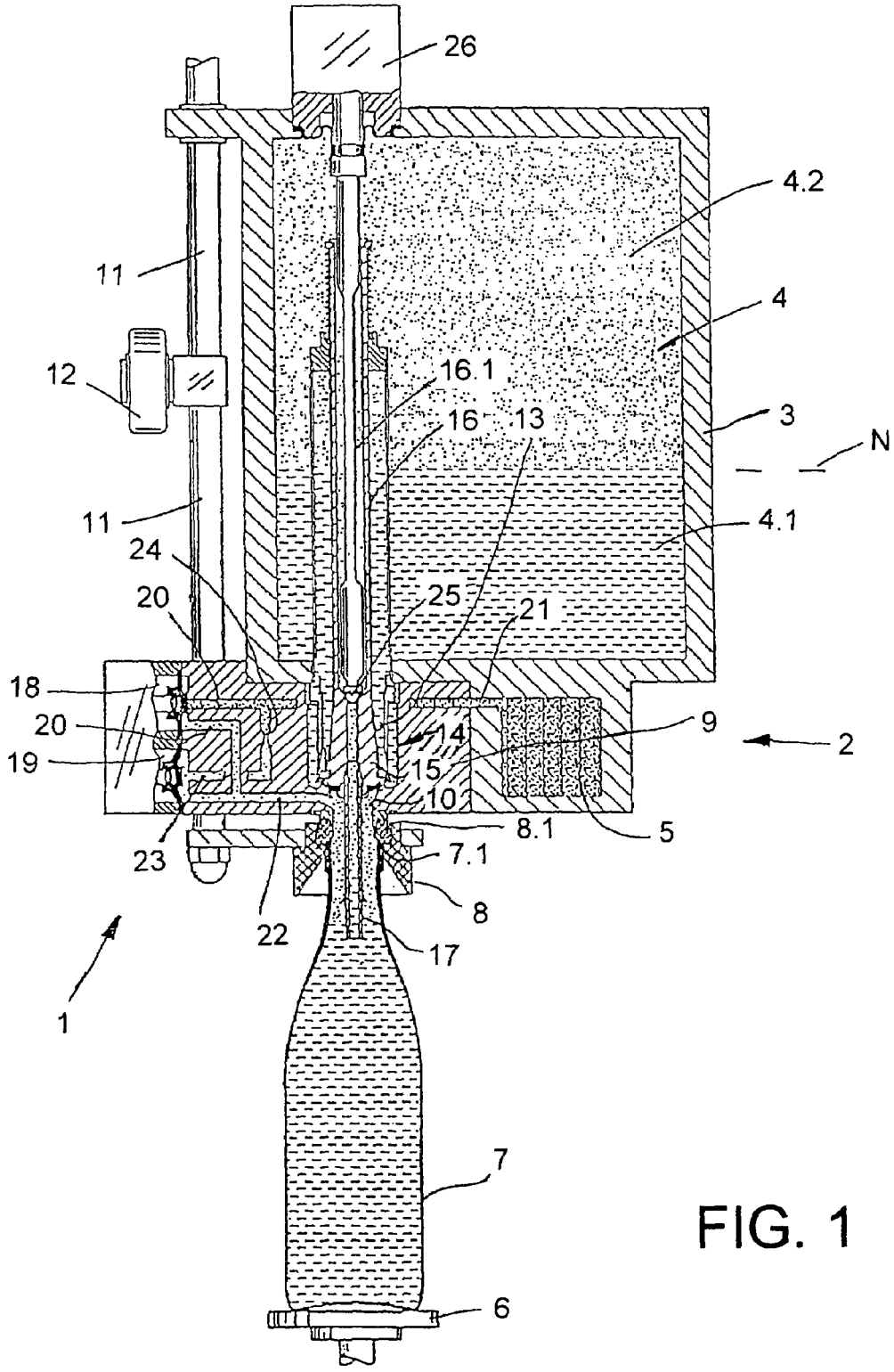
FIG. 1 is a simplified illustration of a filling element without a filling tube of a filling machine that utilizes a rotary construction for the bottling of beverages, in particular of carbonated beverages under counterpressure.
Figure 1A:
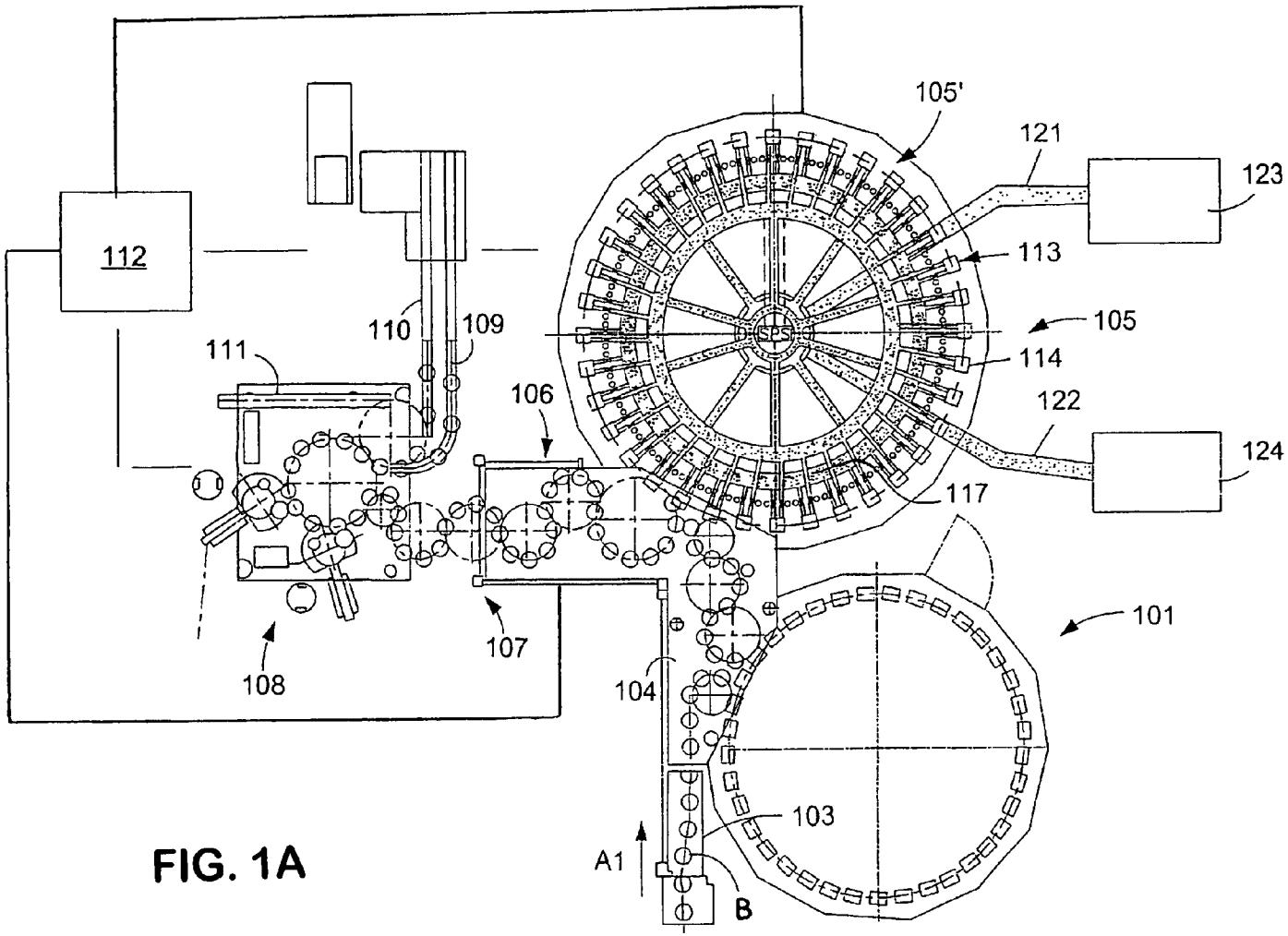
FIG. 1A shows schematically the main components of one possible embodiment example of a system for filling containers, specifically, a beverage bottling plant for filling bottles with at least one liquid beverage.

FIG. 1A shows schematically the main components of one possible embodiment example of a system for filling containers, specifically, a beverage bottling plant for filling bottles B with at least one liquid beverage, in accordance with at least one possible embodiment, in which system or plant could possibly be utilized at least one aspect, or several aspects, of the embodiments disclosed herein.

FIG. 1A shows a rinsing arrangement or rinsing station 101, to which the containers, namely bottles B, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed bottles B are transported to a beverage filling machine 105 by a second conveyer arrangement 104 that is formed, for example, by one or more starwheels that introduce bottles B into the beverage filling machine 105.

The beverage filling machine 105 shown is of a revolving or rotary design, with a rotor 105', which revolves around a central, vertical machine axis. The rotor 105' is designed to receive and hold the bottles B for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles B to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 1A, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling machine 105, in the direction of travel of the bottles B, there can be a beverage bottle closing arrangement or closing station 106 which closes or caps the bottles B. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles B. In the embodiment shown, the labeling arrangement 108 has three output conveyer arrangement: a first output conveyer arrangement 109, a second output conveyer arrangement 110, and a third output conveyer arrangement 111, all of which convey filled, closed, and labeled bottles B to different locations.

The first output conveyer arrangement 109, in the embodiment shown, is designed to convey bottles B that are filled with a first type of liquid beverage supplied by, for example, the supply reservoir 123. The second output conveyer arrangement 110, in the embodiment shown, is designed to convey bottles B that are filled with a second type of liquid beverage supplied by, for example, the supply reservoir 124. The third output conveyer arrangement 111, in the embodiment shown, is designed to convey incorrectly labeled bottles B. To further explain, the labeling arrangement 108 can comprise at least one beverage bottle inspection or monitoring device that inspects or monitors the location of labels on the bottles B to determine if the labels have been correctly placed or aligned on the bottles B. The third output conveyer arrangement 111 removes any bottles B which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

The filling element, which is designated 1 in general in FIG. 1, is a component of a single-chamber filling machine that employs a rotary construction and is provided together with a plurality of identical filling elements 1 that are distributed over the periphery of a rotor 2 at uniform angular intervals around a vertical machine axis. In the illustrated embodiment, the rotor 2 has, among other things, a common ring bowl 3 for all the filling elements, whereby the interior 4 of the ring bowl 3 is filled to a controlled level, i.e. up to a level N, with the liquid product (beverage), so that a gas headspace 4.2 is formed above the level N of the liquid level of the liquid space 4.1. The liquid space 4.1 is connected with a supply line (such as shown in FIG. 1A) that supplies the product under pressure, and the gas headspace 4.2 is connected with a line for the feed of the inert gas that occupies said gas headspace, e.g. $CO_2$, under an initial pressure.

Figure 1B:
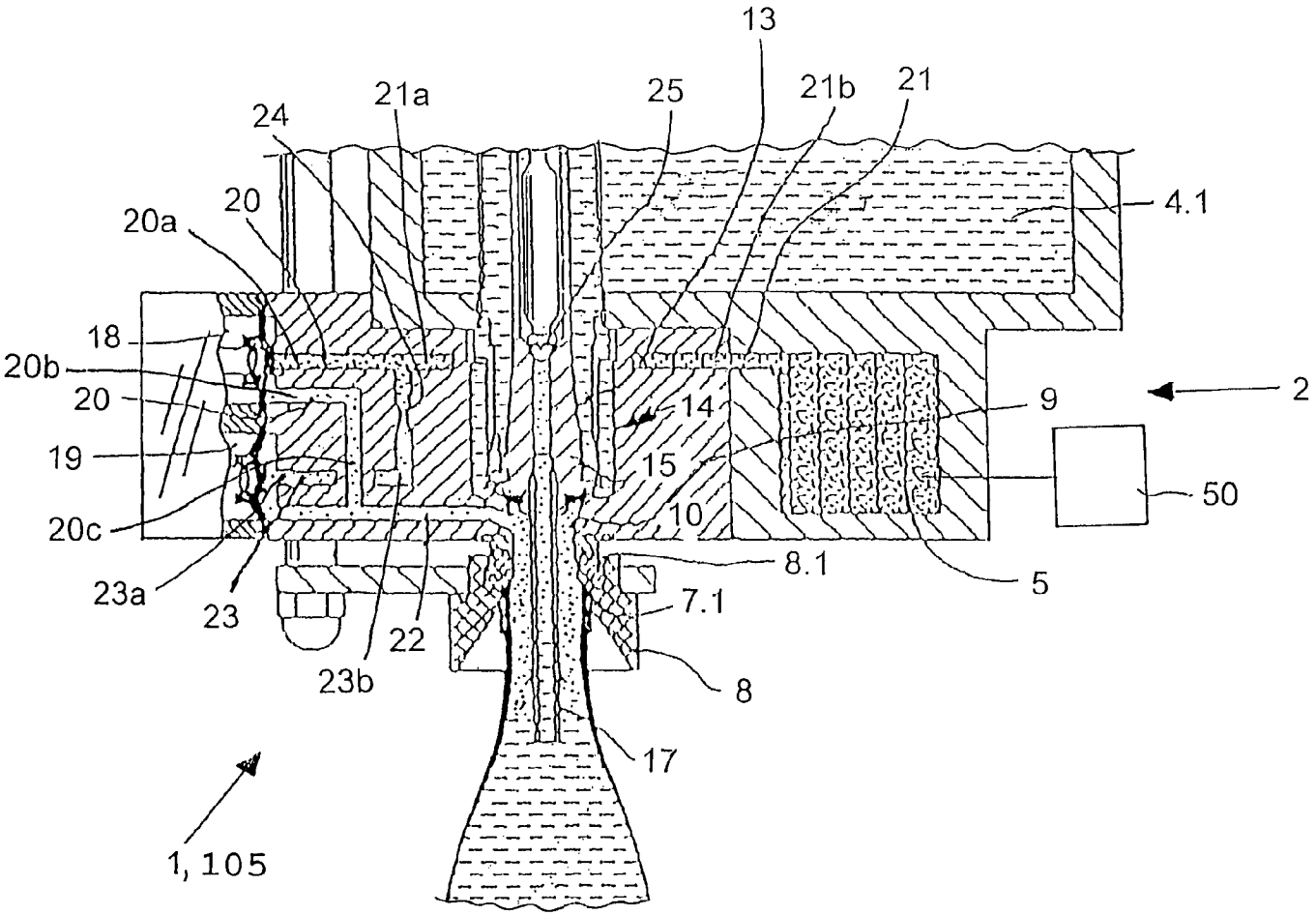
FIG. 1B shows an expanded view of a section of the filling element shown in FIG. 1 with additional detail.

A ring duct 5 common to all the filling elements is also provided in the rotor 2, whereby the ring duct 5, like the ring bowl 3, concentrically encircles the vertical machine axis, is realized in the form of a vacuum duct and for this purpose is connected with a source of reduced pressure or a vacuum or vacuum pump arrangement 50 (see FIG. 1B).

Associated with each filling element 1 is a bottle carrier 6, by means of which the bottle to be filled can be brought in an upright position with its bottle mouth 7.1 into sealed contact by means of a ring-shaped gasket 8.1 that concentrically encircles the filling element axis FA against a likewise ring-shaped dispensing opening 10 that is provided on the underside of a filling element housing 9. The gasket 8.1 is a component of a centering bell 8 of the respective filling element 1 which, as the filling machine rotates, can be moved toward the filling element axis FA under the control of a cam by means of a vertical guide rod 11 and cam roller 12.

In the filling element housing 9, there is, among other things, a liquid duct 13 which with its lower end forms the dispensing opening 10, and with its upper end is connected with the liquid space 4.1. In the liquid duct 13, there is a liquid valve 14 for the controlled starting and stopping of the flow of product into the respective bottle 7 during the filling phase. The liquid valve 14 consists essentially of a valve body 15, which is provided on the lower end with a gas return tube 16 that is equi-axial with the filling element axis FA and interacts with a valve seat in the liquid duct 13.

The upper end of the gas return tube 16, i.e. the upper end of the gas duct 16.1 that is realized in this tube, is in communication with the gas headspace 4.2. Connected to the lower end of the gas return tube 16 is a sensor tube 17, which is also oriented equi-axially with the filling element axis FA and projects by a specified length beyond the underside of the filling element housing 9, and extends into the bottle 7 which is placed in sealed contact with the filling element 1. The sensor tube is, among other things, surrounded by the ring-shaped dispensing opening 10, and with its duct forms the continuation of the gas duct 16.1.

On the filling element housing 9, located radially outboard with reference to the vertical machine axis, are two individually controllable and pneumatically activated control cylinders or control valves 18 and 19, both of which are associated with the vacuum or ring duct 5 and of which the control valve 18 is opened, for example, for a preliminary evacuation of the respective bottle 7, for a flushing of the bottle 7 with inert gas ($CO_2$ gas) from the gas headspace 4.2 and/or for a final evacuation of the bottle 7 prior to the preliminary pressurization of said bottle with inert gas from the gas headspace 4.2, and of which the control valve 19 is opened essentially for the pressure relief of the respective bottle 7 after the filling phase.

Various gas paths are also realized in the filling element housing 9, which gas paths contain said control valves 18 and 19, namely the gas path 20, which contains the control valve 18, and the gas path 23, which contains the control valve 19. Both gas paths are in communication on one hand with a duct 21 that is in communication with the ring duct 5, and on the other hand with a duct 22, which for its part empties into the liquid channel 13, and namely in the direction of product flow downstream of the liquid valve 14 and upstream of the dispensing opening 10. In the gas path 23, between the control valve 19 and the duct 21, a choke or throttle 24 is provided, so that ultimately the control valve 18 and the series connection consisting of the control valve 19 and the choke 24 are provided parallel to each other between the two ducts 21 and 22.

FIG. 1B shows an expanded view of a section of the filling element shown in FIG. 1 with additional detail. The duct 21 is comprised of two sections 21*a* and 21*b*, which are connected to form the duct 21. The gas path 20 is comprised of three sections 20*a*, 20*b*, and 20*c*, which are connected to form the gas path 20. The gas path 23 is comprised of two sections 23*a* and 23*b*, which are connected to form the gas path 20.

The individual bottle 7 can be filled with the liquid product as follows, for example. With the bottle 7 in sealed contact against the filling element 1, first by opening the control valve 18, there is a preliminary evacuation of the interior of the bottle, namely via the two ducts 21 and 22 and the opened gas path 20. Then, for example, the interior of the bottle 7 can be flushed with the inert gas ($CO_2$ gas) from the gas headspace 4.2 For this purpose, for example, the control valve 18 is closed and the control valve 19 is opened, and likewise by means of an actuator device 26, the valve 25 provided in the gas return tube 16 and/or in the duct 16.1 located there is opened, so that inert gas flows into the interior of the bottle 7 through the sensor tube 17, which is open on its lower end, and can flow out via the ducts 21 and 22 and the gas path 23 that is opened by the control valve 19 into the vacuum or ring duct 5. As can be seen in FIG. 1B, the ring duct 5, according to at least one possible embodiment, has a vacuum pump arrangement 50 operatively connected thereto. Another type of actuation of the control valves 18 and 19 for the flushing of the interior of the bottle is also conceivable, such as an opening of the control valve 18, for example. In another possible embodiment, both control valves 18 and 19 could be opened at the same time to allow for an even faster or more accelerated evacuation of air or gas from the bottle. In yet another possible embodiment, the cross section of the gas paths or ducts, such as duct 21, could be increased or decreased as desired to control and/or regulate the flow of air or gas. For example, duct 21 could have a larger cross section to increase the flow of air or gas into the vacuum duct 5.

The flushing can be followed, for example, by a repeated evacuation of the interior of the bottle with the valve 25 closed and the control valve 18 open, whereby the interior of the bottle 7 is once again in communication with the ring duct 5 via the thereby opened gas path 20 and the ducts 21 and 22.

Before the actual filling process, and with the control valves 18 and 19 closed, there is then a preliminary pressurization of the interior of the bottle with inert gas from the gas headspace 4.2 For this purpose, the valve 25 is opened by the actuator device 26, so that by means of the gas return tube 16 and the sensor tube 17, inert gas flows at the preliminary pressurization pressure into the bottle 7. As soon as the pressure in the bottle 7 has reached the preliminary pressurization pressure in the gas headspace 4.2, in the illustrated embodiment the liquid valve 14 opens automatically, so that the product can then flow into the bottle by gravity via the opened liquid valve 14 and the dispensing opening 10 and the inert gas that is thereby displaced from the interior of the bottle 7 flows back via the opened valve 25 into the gas headspace 4.2.

The filling process is ended as soon as the level of the liquid product in the bottle 7 has reached the lower end of the sensor tube 17, i.e. said end is immersed in the liquid product. Then the liquid valve 14 and the valve 25 are closed by means of the actuator device 26.

Figure 2:
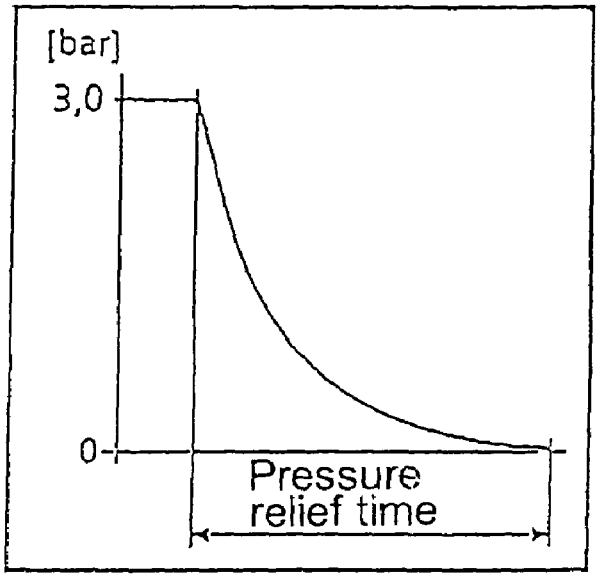
FIG. 2 is a diagram that shows a graph of pressure over time and illustrates the curve of the pressure relief process after the termination of the filling process (filling phase) strictly speaking, i.e. after the final closing of the liquid valve.

For the pressure relief of the bottle 7 to ambient pressure or to approximately ambient pressure, the control valve 19 is then opened by an electronic control system, for example, and remains in the open position for a specified pressure relief time TE, so that the pressure in the bottle can be reduced to a pressure that equals the ambient pressure, for example, as illustrated by the curve illustrated in FIG. 2, and specifically by relieving the pressure via the opened gas path 23 with the choke 24 into the vacuum or ring duct 5. After the pressure relief time TE has passed, the control valve 19 is closed again by the electronic control system.

The pressure relief time TE is a function on one hand of machine parameters such as the flow cross section and flow resistance of the choke 24, the underpressure in the vacuum or ring duct 5 etc., as well as of other parameters that are a function of the specific product being bottled or the bottles, such as the preliminary pressurization pressure in the gas headspace 42, the size and/or shape of the bottles 7 etc. Depending on the size and/or shape of the bottles 7 and the type of product being bottled, the pressure relief time TE can be adjusted, preferably from a control panel on the filling machine, and specifically, for all the filling elements 1 of the filling machine at the same time.

The pressure relief process is started for the individual filling element 1, for example, after the closing of the valve 25 and of the liquid valve 14. The pressure relief process is ended, i.e. the control valve 19 is closed, for example, automatically after the end of the pressure relief time TE.

The pressure is relieved in this manner to minimize bubbling up of the carbonated product or beverage in at least the duct 22 and the gas path 23. In addition, the relief of pressure minimizes bubbling when the seal between the mouth of the bottle 7 and the gasket or seal 8.1 is broken or released by movement of the bottle 7 away from the filling element 1. If the pressure were not relieved prior to breaking of the seal, the effervescent gas in the carbonated beverage could bubble up quickly and forcefully, thereby possibly resulting in spillage of beverage product. Such spillage, as discussed above, is undesirable as it wastes product and causes the bottles and/or the filling machinery and the components thereof, such as the gas ducts 21 and 22, the gas paths 20 and 23, and the dispensing opening of the filling element 1, to become dirty and/or contaminated.

Figure 3:
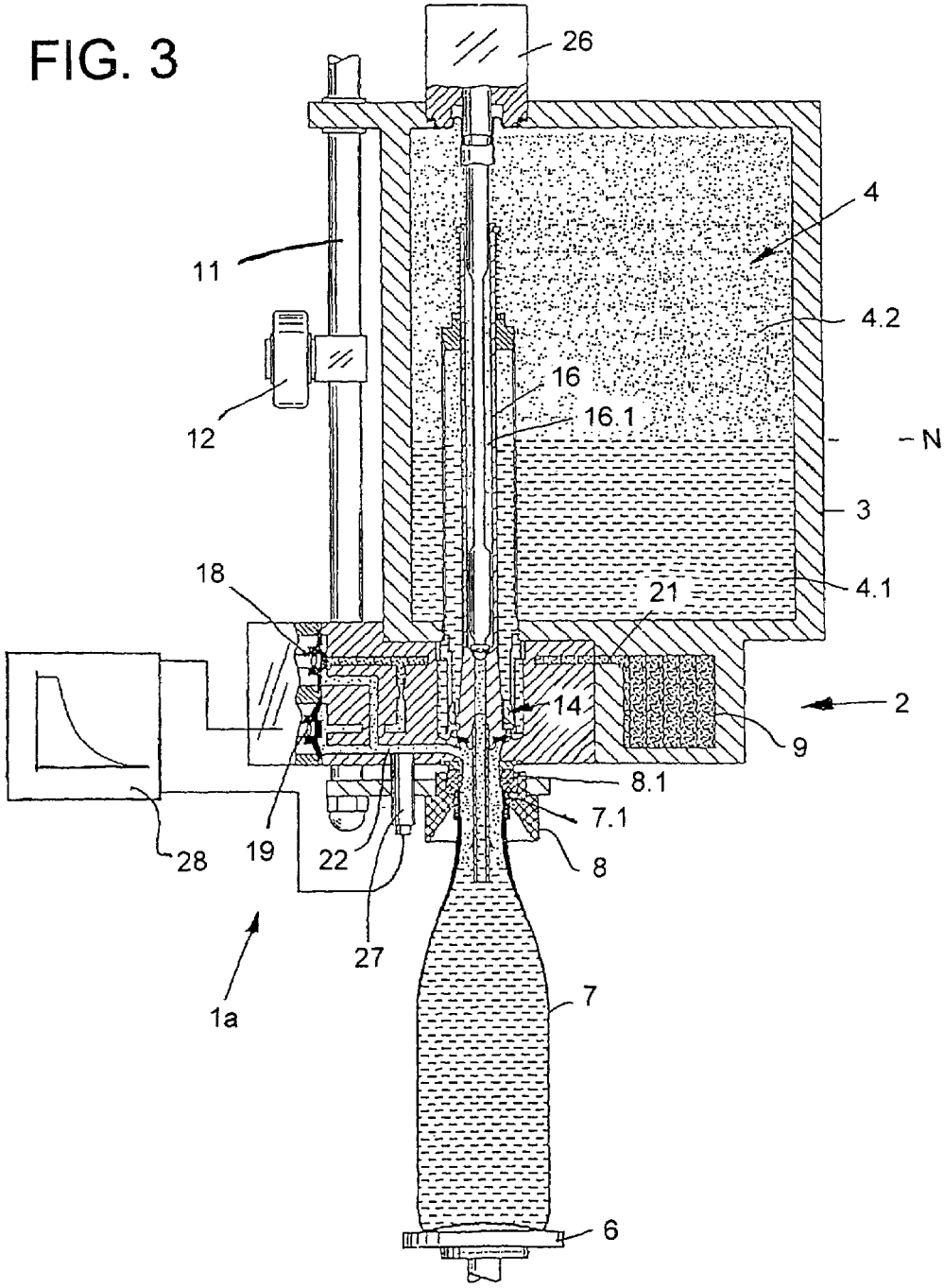
FIGS. 3 and 4 are illustrations similar to FIG. 1, showing two additional possible embodiments.

FIG. 3 illustrates, as an additional possible embodiment, a filling element 1*a* which differs from the filling element 1 illustrated in FIG. 1 only in that in the duct 22, a pressure sensor 27 is provided which measures the pressure in the duct 22 and emits an electrical control or measurement signal corresponding to said pressure to an electronic pressure relief control system 28, which for its part controls the control valve 19 during the pressure relief process or pressure relief phases, and specifically so that after the initiation of the pressure relief by opening the control valve 19, the pressure in the duct 22 and thus in the bottle 7 that is provided at the filling element 1*a* is measured constantly by the pressure sensor 27. As soon as this pressure has reached or has approximately reached the ambient or atmospheric pressure and/or a specified setpoint pressure, the control valve 19 is closed by means of the pressure relief control system 28 of the electronic control system, so that the bottle can then be removed from the filling element 1*a* by lowering the bottle carrier 6. The sensor 27 and the corresponding pressure relief control system 28 are provided separately for each filling element 1*a*, for example, whereby it is also possible for a plurality of pressure sensors 27 of a plurality of filling elements 1*a* or of all the filling elements 1*a* of the filling machine to interact with a common pressure relief control system 28.

In one preferred embodiment of the invention, however, there is only a single filling element and/or only a few filling elements of the filling machine that are realized so that they correspond to the filling element 1*a* with the pressure sensor 27, whereby in that case the pressure relief control system 28 determines on the basis of the signal supplied by the respective pressure sensor 27 during the pressure relief phase the pressure relief time TE that is necessary to reduce the pressure to ambient pressure or to a setpoint pressure, with which then all of the filling elements of the filling machine and/or their control valves 19 are controlled during the respective pressure relief process.

Figure 5:
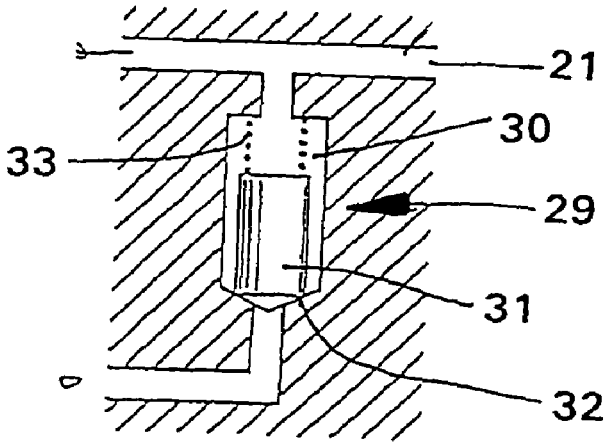
FIG. 5 is an enlarged detail showing a valve provided in a pressure relief duct of the exemplary embodiment illustrated in FIG. 4.
Figure 4:
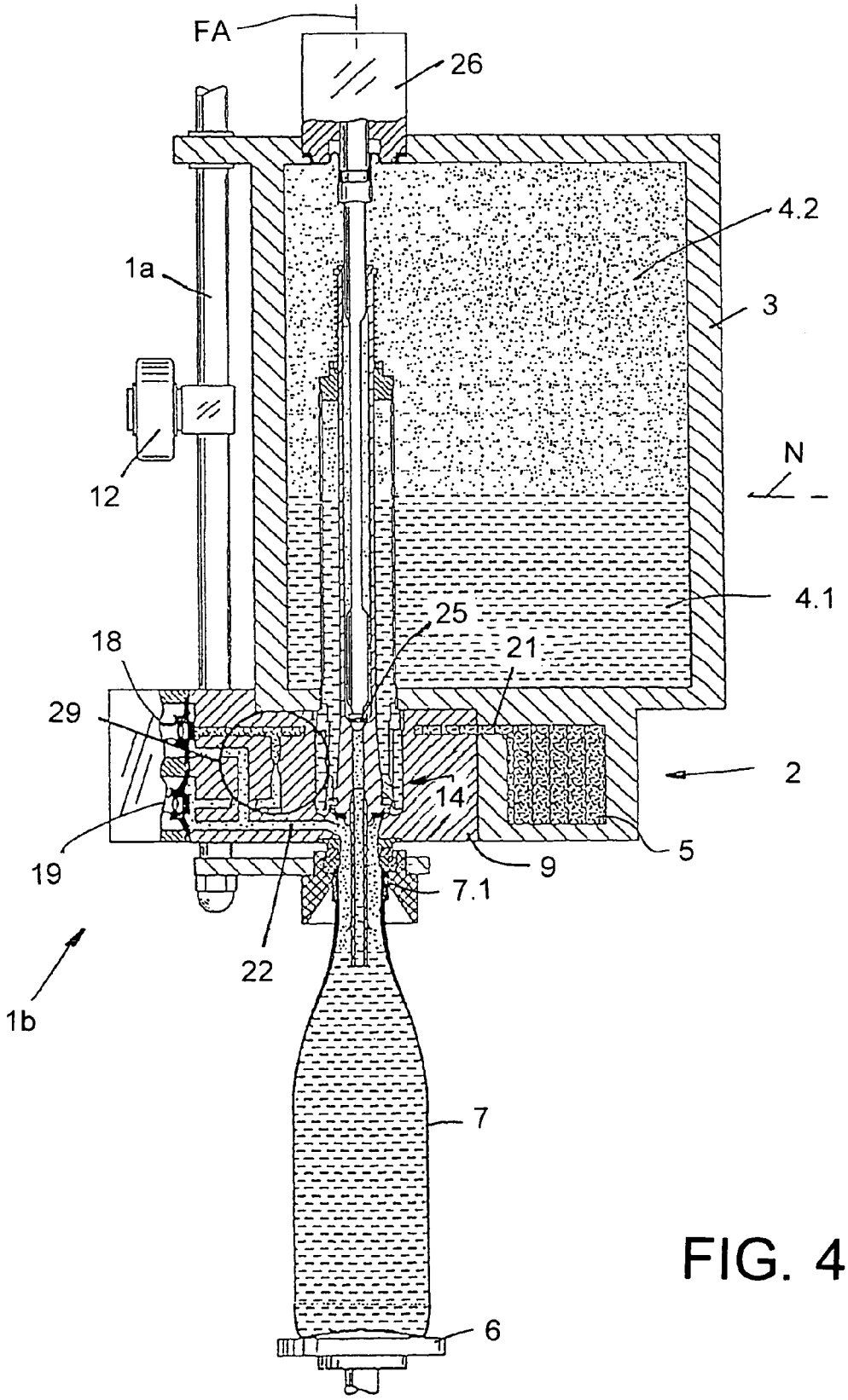

FIGS. 4 and 5 show, as an additional possible embodiment, a filling element 1*b* which differs from the filling element 1 in that in the controlled gas path 23, instead of the choke 24, there is a valve 29 which acts as a choke or regulates the gas flow, and can be realized, for example, in the form of a spring-loaded deadweight valve. The valve 29 has, in a chamber that is realized in the gas path 23, a valve body 31, which with its lower end as illustrated in FIG. 5 interacts with a valve seat 32, and in the position illustrated in FIG. 5 closes the gas path 23. The valve body 31 is biased in this position by its own weight and is assisted by a compression spring 32, from which position the valve body 31, during the pressure relief phase, with an opened control valve 19 and with sufficiently high pressure in the bottle 7 or in the duct 22, is opened by being raised in the vertical direction. The dead weight of the valve body 31 and the force of the spring 33 are selected so that taking into consideration the underpressure in the vacuum or ring duct 5, the valve body 31, after the initiation of the pressure relief phase, i.e. after the opening of the control valve 19, allows a gas flow through the valve 29 until the pressure in the bottle 7 has been reduced to ambient pressure or to approximately ambient pressure. As the pressure approaches ambient pressure, the effective flow cross section of the valve 29 decreases, and/or the throttling action of this valve increases, so that as a result, the specified curve of the pressure decrease during the pressure relief phase is achieved for the smoothest possible reduction of the pressure in the respective bottle 7.

One feature common to all of the exemplary embodiments described above is that the pressure relief takes place by means of throttled or choked means, or the means that regulate the gas flow, into the vacuum duct, i.e. into the ring duct 5, so that an independent pressure relief duct for the filling elements of the filling machine is not necessary, and the result is a particularly simplified configuration, namely one that preserves an optimal pressure curve during the pressure relief phase.

The invention was described above on the basis of several exemplary embodiments. It goes without saying that numerous modifications and variants are possible without thereby going beyond the teaching on which the invention is based.

One feature or aspect of an embodiment is believed at the time of the filing of this patent application to possibly reside broadly in a filling element for a filling machine for filling a liquid product, such as a beverage, for example, under counterpressure in bottles, cans or similar containers 7, with a liquid duct 13 that has a controllable liquid valve 14 and ends in a product dispensing opening 10, with at least one first controlled gas path 2, by means of which the interior of the individual container 7 that is attached to the filling element 1, 1*a*, 1*b* can be connected for an evacuation with a vacuum duct 5 of the filling machine, in which there is also a controlled pressure relief of the container after its filling under counterpressure, wherein for the pressure relief, a second controlled gas path 23 that connects the interior of the container with the vacuum duct 21 is provided with at least one element 24, 29 that reduces and/or regulates the flow in said gas path 23.

Another feature or aspect of an embodiment is believed at the time of the filing of this patent application to possibly reside broadly in the filling element, wherein at least one choke 24 is provided in the second controlled gas path 23.

Yet another feature or aspect of an embodiment is believed at the time of the filing of this patent application to possibly reside broadly in the filling element, wherein in the second, controlled gas path 23 there is at least one valve 29 that regulates the flow, and that opens when there is gas pressure in the gas duct 22 or in the container 7 above atmospheric pressure, and closes at a gas pressure that is equal to or approximately equal to atmospheric pressure.

Still another feature or aspect of an embodiment is believed at the time of the filing of this patent application to possibly reside broadly in the filling element, wherein the valve 29 has a valve body 31 biased by a spring 23 against a valve seat 32.

A further feature or aspect of an embodiment is believed at the time of the filing of this patent application to possibly reside broadly in the filling element, wherein the valve 29 that regulates the flow has a valve body 31 that is in contact against a valve surface 32 by its dead weight.

Another feature or aspect of an embodiment is believed at the time of the filing of this patent application to possibly reside broadly in the filling element, wherein the second controlled gas path 23 has at least one control valve 19, and that control means 28 are provided that automatically open the control valve 19 for the pressure relief and automatically close the control valve 19 after a specified pressure relief time TE.

Yet another feature or aspect of an embodiment is believed at the time of the filing of this patent application to possibly reside broadly in the filling element, wherein the pressure relief time TE is adjustable, and specifically, for example, as a function of the product and/or the type and/or size of the containers 7.

Still another feature or aspect of an embodiment is believed at the time of the filing of this patent application to possibly reside broadly in the filling element, wherein a pressure sensor 27 that supplies a control or measurement signal to the control means 28 to control the control valve in the second gas path 23, which signal corresponds to the pressure in the container 7 or in a gas duct 22 which is in communication with the interior of the container.

A further feature or aspect of an embodiment is believed at the time of the filing of this patent application to possibly reside broadly in the filling element, wherein the control means 28 close the second control valve 19 when the control signal supplied by the pressure sensor 27 corresponds to the ambient pressure or to approximately the ambient pressure or to a specified setpoint pressure.

Another feature or aspect of an embodiment is believed at the time of the filing of this patent application to possibly reside broadly in the filling element, wherein the control means 28 determine, as a function of the measurement signal supplied by the pressure sensor 27, the pressure relief time TE required to reduce the pressure to ambient pressure, with which the second gas path 23 or the filling element or of additional filling elements is closed.

Yet another feature or aspect of an embodiment is believed at the time of the filing of this patent application to possibly reside broadly in the filling element, wherein its configuration in the form of a filling element without a filler tube with a product dispensing opening 10 on an underside of a filling element housing 9, and with a gas return duct 16, 17 which, when a container 7 is attached to the filling element, ends in the interior of the container, whereby the second gas path 23 ends, for example, via the gas duct 22 into the liquid duct 13 in the vicinity of the product dispensing opening 10.

One feature or aspect of an embodiment is believed at the time of the filing of this patent application to possibly reside broadly in a filling machine employing a rotary construction for filling a product in bottles, cans or similar containers 7 under counterpressure and with a subsequent pressure relief to ambient pressure, with a plurality of filling elements 1, 1*a*, 1*b* on a rotor 2 that can be driven so that it rotates around a vertical machine axis, wherein the filling elements are realized as disclosed herein above.

Another feature or aspect of an embodiment is believed at the time of the filing of this patent application to possibly reside broadly in the filling machine, wherein the pressure relief time TE can be set or adjusted for all of the filling elements 1 of the filling machine at once.

Yet another feature or aspect of an embodiment is believed at the time of the filing of this patent application to possibly reside broadly in the filling machine, wherein at least one filling element 1*a* of the filling machine has a pressure sensor 27 in the pressure relief duct 22, 23.

Still another feature or aspect of an embodiment is believed at the time of the filing of this patent application to possibly reside broadly in the filling machine, wherein each of the filling elements 1*a* of the filling machine has its own pressure sensor 27 in the pressure relief duct 22, 23.

A further feature or aspect of an embodiment is believed at the time of the filing of this patent application to possibly reside broadly in the filling machine, wherein the pressure relief control system 28 that interacts with the pressure sensor 27 determines the pressure relief time TE for the control of the second gas path 23, with which pressure relief time the pressure relief of all of the filling elements that are associated with the filling element with the pressure sensor 27 is controlled.

Another feature or aspect of an embodiment is believed at the time of the filing of this patent application to possibly reside broadly in the filling machine, wherein only one filling element 1*a* of the filling machine has the pressure sensor 27 that measures the pressure in the pressure relief duct 22, 23.

One feature or aspect of an embodiment is believed at the time of the filing of this patent application to possibly reside broadly in a beverage bottle filling machine for filling beverage bottles with a carbonated liquid beverage material in a beverage bottling plant, said beverage bottle filling machine comprising: a rotor; a rotatable vertical machine column; said rotor being connected to said vertical machine column to permit rotation of said rotor about said vertical machine column; at least one liquid reservoir being configured to hold a supply of liquid beverage material; a first star wheel structure being configured and disposed to move beverage bottles into said beverage bottle filling machine; a second star wheel structure being configured and disposed to move beverage bottles out of said beverage bottle filling machine; a plurality of beverage bottle filling elements for filling beverage bottles with liquid beverage material being disposed on the periphery of said rotor; each of said plurality of beverage bottle filling elements being configured and disposed to dispense liquid beverage material under counterpressure into beverage bottles to be filled in a sealed filling process; and each of said plurality of beverage bottle filling elements comprising: a dispensing opening being configured and disposed to permit dispensing of liquid beverage therethrough to beverage bottles to be filled; a liquid duct being configured and disposed to connect said at least one liquid reservoir and said dispensing opening; said liquid duct comprising a liquid valve being disposed adjacent said dispensing opening; said liquid valve being configured and disposed to control the dispensation of liquid beverage into bottles to be filled; a container carrier being configured and disposed to receive and hold beverage bottles to be filled; said dispensing opening comprising a sealing structure being configured and disposed to be sealingly engaged with the mouths of beverage bottles; said container carrier being configured and disposed to bring beverage bottles to be filled into sealing engagement with said sealing structure of said dispensing opening; a vacuum arrangement being configured to evacuate gas from the interior of beverage bottles before and during filling of the beverage bottles with a liquid beverage; a first gas path being configured and disposed to operatively connect said vacuum arrangement to beverage bottles to permit evacuation of gas from the interior of beverage bottles; a second gas path being configured and disposed to operatively connect said vacuum arrangement to beverage bottles to permit evacuation of gas from the interior of beverage bottles; and said second gas path comprising at least one element being configured and disposed to reduce and/or regulate flow of gas in said second gas path to control relief of pressure in beverage bottles after filling of the beverage bottles has been completed to minimize bubbling up of effervescent gas from the filled beverage bottles.

The invention, according to at least one possible embodiment, relates to a filling element 1 for a filling machine for filling a product, for example, a beverage under counterpressure in bottles, cans or similar receptacles 7, comprising: a liquid channel 13, which has a controllable liquid valve 14 and which terminates in a product discharge opening 10; at least one first controlled gas passage 20, via which the interior of the receptacle respectively placed on the filling element can, for evacuating, be connected to a vacuum channel 5 of the filling machine and into which a controlled pressure release of the receptacle ensues after the receptacle has been filled under counterpressure. The invention provides that, for releasing pressure, a second controlled gas passage 23 is provided, which connects the interior of the receptacle to the vacuum channel 21 and which has at least one element 24, 29 that reduces and/or controls the flow inside this gas passage.

For the filling of bottles or similar containers with a carbonated product such as beer or soft drinks, for example, after the end of the filling phase strictly speaking, i.e. after the final closing of the liquid valve of the respective filling element, it is desirable to reduce the pressure in the container, which is still in sealed contact with the related filling element, to the ambient pressure or to atmospheric pressure before the container is removed from the filling element. One possible solution is to provide a common pressure relief duct for all the filling elements on the filling machine in question, by means of which the container in question can be connected in a controlled manner to a gas path of the filling element to relieve the pressure in the container. However, a pressure relief duct of this type entails additional constructive effort and expense.

In some other types of filling machines, before the actual filling phase and, for example, before a flushing of the individual container with an inert gas (e.g. $CO_2$ gas) and/or before a pre-pressurization of the interior of the container with the inert gas under pressure, the individual container can be evacuated, i.e. it can be connected via a controlled gas path of the respective filling element with a vacuum duct that is common to all of the filling elements of the filling machine.

The components disclosed in the various publications, disclosed or incorporated by reference herein, may possibly be used in possible embodiments of the present invention, as well as equivalents thereof.

Some examples of bottling and container handling systems and components thereof which may possibly be utilized or adapted for use in at least one possible embodiment, may possibly be found in the following U.S. Pat. No. 6,484,477, entitled "Capping Machine for Capping and Closing Containers, and a Method for Closing Containers;" U.S. Pat. No. 6,474,368, entitled "Beverage Container Filling Machine, and Method for Filling Containers with a Liquid Filling Material in a Beverage Container Filling Machine;" U.S. Pat. No. 6,494,238, entitled "A Plant for Filling Beverage into Beverage Bottles Other Beverage Containers Having Apparatus for Replacing Remaining Air Volume in Filled Beverage Bottles or Other Beverage Containers;" U.S. Pat. No. 6,470,922, entitled "Apparatus for the Recovery of an Inert Gas;" U.S. Pat. No. 6,463,964, entitled "Method of Operating a Plant for Filling Bottles, Cans or the like Beverage Containers with a Beverage, and a Beverage Container Filling Machine;" U.S. Pat. No. 6,834,473, entitled "Bottling Plant and Method of Operating a Bottling Plant and a Bottling Plant with Sections for Stabilizing the Bottled Product;" U.S. Pat. No. 6,484,762, entitled "A Filling System with Post-dripping Prevention;" and U.S. Pat. No. 6,668,877, entitled "Filling System for Still Beverages."

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

Some examples of bottling and container handling systems and components thereof which may possibly be utilized or adapted for use in at least one possible embodiment, may possibly be found in the following U.S. patent applications Ser. No. 10/653,617, filed on Sep. 2, 2003, entitled "Labeling Machine with a Sleeve Mechanism for Preparing and Applying Cylindrical Labels onto Beverage Bottles and Other Beverage Containers in a Beverage Container Filling Plant;" Ser. No. 10/666,931, filed on Sep. 18, 2003, entitled "Beverage Bottling Plant for Filling Bottles with a Liquid Beverage Filling Material and a Labelling Station for Filled Bottles and Other Containers;" Ser. No. 10/723,451, filed on Nov. 26, 2003, entitled "Beverage Bottling Plant for Filling Beverage Bottles or Other Beverage Containers with a Liquid Beverage Filling Material and Arrangement for Dividing and Separating of a Stream of Beverage Bottles or Other Beverage Containers;" Ser. No. 10/739,895, filed on Dec. 18, 2003, entitled "Method of Operating a Beverage Container Filling Plant with a Labeling Machine for Labeling Beverage Containers Such as Bottles and Cans, and a Beverage Container Filling Plant with a Labeling Machine for Labeling Beverage Containers Such as Bottles and Cans;" Ser. No. 10/756,171, filed on Jan. 13, 2004, entitled "A Beverage Bottling Plant for Filling Bottles and like Containers with a Liquid Beverage Filling Material and a Conveyer Arrangement for Aligning and Distributing Packages Containing Filled Bottles and like Containers;" Ser. No. 10/780,280, entitled "A Beverage Bottling Plant for Filling Bottles with a Liquid Beverage Filling Material, a Container Filling Plant Container Information Adding Station, Such As, a Labeling Station, Configured to Add Information to Containers, Such As, Bottles and Cans, and Modules for Labeling Stations;" Ser. No. 10/786,256, entitled "A Beverage Bottling Plant for Filling Bottles with a Liquid Beverage Filling Material, and a Container Filling Lifting Device for Pressing Containers to Container Filling Machines;" Ser. No. 10/793,659, entitled "A Beverage Bottling Plant for Filling Bottles with a Liquid Beverage Filling Material, and a Container Filling Plant Container Information Adding Station, Such As, a Labeling Station Having a Sleeve Label Cutting Arrangement, Configured to Add Information to Containers, Such As, Bottles and Cans;" Ser. No. 10/801,924, filed on Mar. 16, 2004, entitled "Beverage Bottling Plant for Filling Bottles with a Liquid Beverage Filling Material, and a Cleaning Device for Cleaning Bottles in a Beverage Bottling Plant;" Ser. No. 10/813,651, filed on Mar. 30, 2004, entitled "A Beverage Bottling Plant for Filling Bottles with a Liquid Beverage Filling Material, and an Easily Cleaned Lifting Device in a Beverage Bottling Plant;" Ser. No. 10/814,624, filed on Mar. 31, 2004, entitled "A Beverage Bottling Plant for Filling Bottles with a Liquid Beverage Filling Material, and a Container Filling Plant Container Information Adding Station, Such As, a Labeling Station Having a Gripper Arrangement, Configured to Add Information to Containers, Such As, Bottles and Cans;" Ser. No. 10/816,787, filed on Apr. 2, 2004, entitled "A Beverage Bottling Plant for Filling Bottles with a Liquid Beverage Filling Material, and Apparatus for Attaching Carrying Grips to Containers with Filled Bottles;" Ser. No. 10/865,240, filed on Jun. 10, 2004, Entitled "A Beverage Bottling Plant for Filling Bottles with a Liquid Beverage Filling Material, a Beverage Container Filling Machine, and a Beverage Container Closing Machine;" Ser. No. 10/883,591, filed on Jul. 1, 2004, entitled "A Beverage Bottling Plant for Filling Bottles with a Liquid Beverage Filling Material Having a Container Filling Plant Container Information Adding Station, Such As, a Labeling Station, Configured to Add Information to Containers, Such As, Bottles and Cans, and Modules for Labeling Stations and a Bottling Plant Having a Mobile Module Carrier;" Ser. No. 10/930,678, filed on Aug. 31, 2004, entitled "A Beverage Bottling Plant for Filling Bottles with a Liquid Beverage Filling Material, a Container Filling Plant Container Filling Machine, and a Filter Apparatus for Filtering a Liquid Beverage;" Ser. No. 10/931,817, filed on Sep. 1, 2004, entitled "A Beverage Bottling Plant for Filling Bottles with a Liquid Beverage Filling Material, Having an Apparatus for Exchanging Operating Units Disposed at Rotating Container Handling Machines;" Ser. No. 10/939,170, filed on Sep. 10, 2004, Ser. No. 10/954,012, filed on Sep. 29, 2004, Ser. No. 10/952,706, Ser. No. 10/962,183, filed on Oct. 8, 2004, Ser. No. 10/967,016, filed on Oct. 15, 2004, Ser. No. 10/982,706, filed on Nov. 5, 2004, Ser. No. 10/982,694, Ser. No. 10/982,710, Ser. No. 10/984,677, filed on Nov. 9, 2004, Ser. No. 10/985,640, filed on Nov. 10, 2004, Ser. No. 11/004,663, filed on Dec. 3, 2004, Ser. No. 11/009,551, filed on Dec. 10, 2004, Ser. No. 11/012,859, filed on Dec. 15, 2004, Ser. No. 11/014,673, filed on Dec. 16, 2004, Ser. No. 11/016,364, filed on Dec. 17, 2004, and Ser. No. 11/016,363.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

Some examples of filling systems and components thereof which may possibly be utilized or adapted for use in at least one possible embodiment, may possibly be found in the following U.S. patent application Ser. No. 11/090,949, filed Mar. 25, 2005 and Ser. No. 11/102,548, filed Apr. 8, 2005 and both of which are incorporated by reference as if set forth in their entirety herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

An example of a deadweight valve which may possibly be utilized or adapted for use in at least one possible embodiment, may possibly be found in U.S. Pat. No. 6,019,126, issued on Feb. 1, 2000. An example of a gas pressure regulator and components thereof which may possibly be utilized or adapted for use in at least one possible embodiment, may possibly be found in U.S. Pat. No. 4,817,664, issued on Apr. 4, 1989. An example of closed-loop and open-loop control valves and components thereof which may possibly be utilized or adapted for use in at least one possible embodiment, may possibly be found in U.S. Pat. No. 6,637,207 B2, issued on Oct. 28, 2003. Examples of spring-loaded control valves and components thereof which may possibly be utilized or adapted for use in at least one possible embodiment, may possibly be found in U.S. Pat. No. 5,810,327, issued on Sep. 22, 1998, and U.S. Pat. No. 6,019,126, issued on Feb. 1, 2000. All of the preceding patents are hereby incorporated by reference as if set forth in their entirety herein.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

All of the patents, patent applications or patent publications, which were cited in the International Search Report dated Feb. 23, 2005, and/or cited elsewhere are hereby incorporated by reference as if set forth in their entirety herein as follows: DE 199 39 521 A1; US 2002/139434 A1; U.S. Pat. No. 4,644,981 A; and DE 44 02 980 C1.

The corresponding foreign and international patent publication applications, namely, Federal Republic of Germany Patent Application No. 103 59 492.2, filed on Dec. 13, 2003, having inventor Ludwig CLÜSSERATH, and DE-OS 103 59

492.2 and DE-PS 103 59 492.2, and International Application No. PCT/EP2004/014088, filed on Dec. 10, 2004, having WIPO Publication No. WO2005/056464 A1 and inventor Ludwig CLÜSSERATH, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

At least partial nomenclature

| | |
|---|---|
| 1, 1a, 1b | Filling element |
| 2 | Rotor |
| 3 | Ring bowl |
| 4 | Interior of bowl |
| 4.1 | Liquid space of the ring bowl |
| 4.2 | Gas headspace of the ring bowl |
| 5 | Vacuum or ring duct |
| 6 | Bottle carrier |
| 7 | Bottle |
| 7.1 | Bottle mouth |
| 8 | Centering bell |
| 8.1 | Gasket |
| 9 | Filling element housing |
| 10 | Dispensing opening |
| 11 | Guide rod |
| 12 | Cam roller |
| 13 | Liquid duct |
| 14 | Liquid valve |
| 15 | Valve body |
| 16 | Gas return tube |
| 16.1 | Duct in gas return tube |
| 17 | Sensor tube |
| 18, 19 | Control valve |
| 20 | Gas path |
| 21, 22 | Gas duct |
| 23 | Gas path |
| 24 | Choke |
| 25 | Valve in gas return tube |
| 26 | Actuator device |
| 27 | Pressure sensor |
| 28 | Pressure relief control |
| 29 | Valve with throttle action |
| 30 | Valve space |
| 31 | Valve body |
| 32 | Valve seat |
| 33 | Compression spring |
| FA | Filling element axis |

What is claimed is:

1. A beverage bottle filling machine for filling beverage bottles with a carbonated liquid beverage material in a beverage bottling plant, said beverage bottle filling machine comprising:

a rotor;

a rotatable vertical machine column;

said rotor being connected to said vertical machine column to permit rotation of said rotor about said vertical machine column;

at least one liquid reservoir being configured to hold a supply of carbonated liquid beverage material;

a first star wheel structure being configured and disposed to move beverage bottles into said beverage bottle filling machine;

a second star wheel structure being configured and disposed to move beverage bottles out of said beverage bottle filling machine;

a plurality of beverage bottle filling elements for filling beverage bottles with carbonated liquid beverage material being disposed on the periphery of said rotor;

each of said plurality of beverage bottle filling elements being configured and disposed to dispense carbonated liquid beverage material under counterpressure into beverage bottles to be filled in a sealed filling process; and each of said plurality of beverage bottle filling elements comprising:

a dispensing opening being configured and disposed to permit dispensing of carbonated liquid beverage therethrough to beverage bottles to be filled;

a liquid duct being configured and disposed to connect said at least one liquid reservoir and said dispensing opening;

said liquid duct comprising a liquid valve arrangement being disposed adjacent said dispensing opening;

said liquid valve arrangement being configured and disposed to control the dispensation of carbonated liquid beverage into beverage bottles to be filled;

said liquid valve arrangement comprising a movable liquid valve body and a liquid valve seat;

said liquid valve body being configured to be moved into sealing engagement with said liquid valve seat to close said liquid valve arrangement, and being configured to be moved out of sealing engagement with said liquid valve seat to open said liquid valve arrangement;

a gas tube being disposed to pass through and project from said liquid valve body and into a beverage bottle;

said gas tube comprising a gas tube valve;

said gas tube valve being configured to be opened to permit the inflow of inert gas into a beverage bottle to pressurize a beverage bottle prior to filling of a beverage bottle, and to permit the outflow of inert gas from a beverage bottle during filling of a beverage bottle;

said gas tube comprising a sensor structure being disposed at an end of said gas tube;

said sensor structure being configured to detect a level of carbonated liquid beverage material in a beverage bottle;

said end of said gas tube being configured to be disposed within a beverage bottle adjacent a neck portion of the beverage bottle during filling;

an actuator device being operatively connected to said liquid valve arrangement and said gas tube valve to control the opening and closing of said liquid valve arrangement and said gas tube valve;

said actuator device being configured to open said liquid valve arrangement to permit filling of a beverage bottle, and to close said liquid valve arrangement to terminate filling of a beverage bottle upon detection of a level of carbonated liquid beverage material in a beverage bottle by said sensor structure;

said actuator device being configured to open said gas tube valve during filling of a beverage bottle, and to close said gas tube valve upon termination of filling of a beverage bottle;

a container carrier being configured and disposed to receive and hold beverage bottles to be filled;

said dispensing opening comprising a sealing structure being configured and disposed to be sealingly engaged with the mouths of beverage bottles;

said container carrier being configured and disposed to bring beverage bottles to be filled into sealing engagement with said sealing structure of said dispensing opening;

a sole vacuum duct being configured to evacuate gas from the interior of beverage bottles before and after filling of the beverage bottles with a carbonated liquid beverage;

a first gas path being configured and disposed to operatively connect said sole vacuum duct to beverage bottles to permit solely evacuation of gas from the interior of beverage bottles;

a second gas path being configured and disposed to operatively connect said sole vacuum duct to beverage bottles to permit solely evacuation of gas from the interior of beverage bottles; and said second gas path comprising at least one element being configured and disposed to reduce and/or regulate flow of gas in said second gas path to control relief of pressure in beverage bottles after filling of the beverage bottles has been completed to minimize bubbling up of effervescent gas from the filled beverage bottles.

2. The beverage bottle filling machine according to claim 1, wherein:

one of:

at least one choke is provided in the second controlled gas path; and in the second, controlled gas path there is at least one valve that regulates the flow, and that opens when there is gas pressure in the gas duct or in the container above atmospheric pressure, and closes at a gas pressure that is equal to or approximately equal to atmospheric pressure;

the valve has a valve body that is: biased by a spring against a valve seat, or in contact against a valve surface by its dead weight;

the second controlled gas path has at least one control valve, and that control means are provided that automatically open the control valve for the pressure relief and automatically close the control valve after a specified pressure relief time;

the pressure relief time is adjustable, as a function of the product and/or the type and/or size of the containers;

the filling element comprises a pressure sensor that supplies a control or measurement signal to the control means to control the control valve in the second gas path, which signal corresponds to the pressure in the container or in a gas duct which is in communication with the interior of the container;

the control means close the second control valve when the control signal supplied by the pressure sensor corresponds to the ambient pressure or to approximately the ambient pressure or to a specified setpoint pressure;

the control means determine, as a function of the measurement signal supplied by the pressure sensor, the pressure relief time required to reduce the pressure to ambient pressure, with which the second gas path or the filling element or of additional filling elements is closed;

the filling element's configuration in the form of a filling element without a filler tube with a product dispensing opening on an underside of a filling element housing, and with a gas return duct which, when a container is attached to the filling element, ends in the interior of the container, whereby the second gas path ends via the gas duct into the liquid duct in the vicinity of the product dispensing opening;

the pressure relief time can be set or adjusted for all of the filling elements of the filling machine at once;

at least one filling element of the filling machine has a pressure sensor in the pressure relief duct;

each of the filling elements of the filling machine has its own pressure sensor in the pressure relief duct;

the pressure relief control system that interacts with the pressure sensor determines the pressure relief time for the control of the second gas path, with which pressure relief time the pressure relief of all of the filling elements that are associated with the filling element with the pressure sensor is controlled; and only one filling element of the filling machine has the pressure sensor that measures the pressure in the pressure relief duct.

3. A filling element for a beverage bottle filling machine, said filling element comprising:

a dispensing opening being configured and disposed to permit dispensing of carbonated liquid beverage therethrough to beverage bottles to be filled;

a liquid duct being configured and disposed to connect said at least one liquid reservoir and said dispensing opening;

said liquid duct comprising a liquid valve arrangement being disposed adjacent said dispensing opening;

said liquid valve arrangement being configured and disposed to control the dispensation of carbonated liquid beverage into beverage bottles to be filled;

said liquid valve arrangement comprising a movable liquid valve body and a liquid valve seat;

said liquid valve body being configured to be moved into sealing engagement with said liquid valve seat to close said liquid valve arrangement, and being configured to be moved out of sealing engagement with said liquid valve seat to open said liquid valve arrangement;

a gas tube being disposed to project into a beverage bottle;

said gas tube comprising a gas tube valve;

said gas tube valve being configured to be opened to permit the inflow of inert gas into a beverage bottle to pressurize a beverage bottle prior to filling of a beverage bottle, and to permit the outflow of inert gas from a beverage bottle during filling of a beverage bottle;

said gas tube comprising a sensor structure being disposed at an end of said gas tube;

said sensor structure being configured to detect a level of carbonated liquid beverage material in a beverage bottle;

a control arrangement being operatively connected to said liquid valve arrangement and said gas tube valve to control the opening and closing of said liquid valve arrangement and said gas tube valve;

said control arrangement being configured to open said liquid valve arrangement to permit filling of a beverage bottle, and to close said liquid valve arrangement to terminate filling of a beverage bottle upon detection of a level of carbonated liquid beverage material in a beverage bottle by said sensor structure;

said control arrangement being configured to open said gas tube valve prior to and/or during filling of a beverage bottle, and to close said gas tube valve upon termination of filling of a beverage bottle;

a container carrier being configured and disposed to receive and hold beverage bottles to be filled;

said dispensing opening comprising a sealing structure being configured and disposed to be sealingly engaged with the mouths of beverage bottles;

said container carrier being configured and disposed to bring beverage bottles to be filled into sealing engagement with said sealing structure of said dispensing opening;

a vacuum duct being configured to evacuate gas from the interior of beverage bottles before and after filling of the beverage bottles with a carbonated liquid beverage;

a first gas path being configured and disposed to operatively connect said vacuum duct to beverage bottles to permit evacuation of gas from the interior of beverage bottles;

a second gas path being configured and disposed to operatively connect said vacuum duct to beverage bottles to permit evacuation of gas from the interior of beverage bottles; and said second gas path comprising at least one element being configured and disposed to reduce and/or regulate flow of gas in said second gas path to control relief of pressure in beverage bottles after filling of the beverage bottles has been completed to minimize bubbling from the beverage bottles.

4. The filling element according to claim 3, wherein one of:

said first controlled gas path is configured to permit solely evacuation of gas from the interior of containers;

said second controlled gas path is configured to permit solely evacuation of gas from the interior of containers;

at least one choke is provided in the second controlled gas path; and in the second, controlled gas path there is at least one valve that regulates the flow, and that opens when there is gas pressure in the gas duct or in the container above atmospheric pressure, and closes at a gas pressure that is equal to or approximately equal to atmospheric pressure.

5. The filling element according to claim 4, wherein the valve has a valve body that is: biased by a spring against a valve seat, or in contact against a valve surface by its dead weight.

6. The filling element according to claim 5, wherein the second controlled gas path has at least one control valve, and that control means are provided that automatically open the control valve for the pressure relief and automatically close the control valve after a specified pressure relief time.

7. The filling element according to claim 6, wherein the pressure relief time is adjustable, as a function of the product and/or the type and/or size of the containers.

8. The filling element according to claim 7, wherein the filling element comprises a pressure sensor that supplies a control or measurement signal to the control means to control the control valve in the second gas path, which signal corresponds to the pressure in the container or in a gas duct which is in communication with the interior of the container.

9. The filling element according to claim 8, wherein the control means close the second control valve when the control signal supplied by the pressure sensor corresponds to the ambient pressure or to approximately the ambient pressure or to a specified setpoint pressure.

10. The filling element according to claim 9, wherein:

the control means determine, as a function of the measurement signal supplied by the pressure sensor, the pressure relief time required to reduce the pressure to ambient pressure, with which the second gas path or the filling element or of additional filling elements is closed; and the filling element's configuration in the form of a filling element without a filler tube with a product dispensing opening on an underside of a filling element housing, and with a gas return duct which, when a container is attached to the filling element, ends in the interior of the container, whereby the second gas path ends via the gas duct into the liquid duct in the vicinity of the product dispensing opening.

11. The filling element according to claim 10 in combination with a filling machine employing a rotary construction for filling a product in bottles, cans or similar containers under counterpressure and with a subsequent pressure relief to ambient pressure, with a plurality of filling elements on a rotor that can be driven so that it rotates around a vertical machine axis.

12. The combination according to claim 11, wherein:

the pressure relief time can be set or adjusted for all of the filling elements of the filling machine at once; and at least one filling element of the filling machine has a pressure sensor in the pressure relief duct.

13. The combination according to claim 12, wherein:

each of the filling elements of the filling machine has its own pressure sensor in the pressure relief duct;

the pressure relief control system that interacts with the pressure sensor determines the pressure relief time for the control of the second gas path, with which pressure relief time the pressure relief of all of the filling elements that are associated with the filling element with the pressure sensor is controlled; and only one filling element of the filling machine has the pressure sensor that measures the pressure in the pressure relief duct.

14. A filling element for a filling machine for filling a liquid product, such as a beverage, under counterpressure in bottles, cans or similar containers, said filling element comprising:

a liquid duct comprising a controllable liquid valve and a product dispensing opening;

a vacuum duct;

a gas tube being disposed to project into a container;

said gas tube comprising a gas tube valve;

said gas tube valve being configured to be opened to permit the inflow of inert gas into the container to pressurize the container prior to filling of the container, and to permit the outflow of inert gas from the container during filling of the container;

a control arrangement being operatively connected to said liquid valve and said gas tube valve to control the opening and closing of said liquid valve and said gas tube valve;

said control arrangement being configured to open said liquid valve to permit filling of the container, and to close said liquid valve to terminate filling of the container upon the container being filled; said control arrangement being configured to open said gas tube valve prior to and/or during filling of the container, and to close said gas tube valve upon termination of filling of the container;

at least one first controlled gas path being configured to connect the interior of a container that is attached to the filling element for an evacuation with said vacuum duct filling machine, in which there is and a second controlled gas path being configured to perform a controlled pressure relief of the container after termination of the filling of the container under counterpressure, which second controlled gas path connects the interior of the container with said vacuum duct and comprises at least one element that reduces and/or regulates the flow in said second controlled gas path.

15. The filling element according to claim 14, wherein:

said gas tube comprises a sensor structure disposed at an end of said gas tube;

said sensor structure is configured to detect a level of liquid product in a container;

said end of said gas tube is configured to be disposed within a container adjacent an upper portion of the container during filling; and at least one choke is provided in the second controlled gas path.

16. The filling element according to claim 15, wherein:

said first controlled gas path is configured to permit solely evacuation of gas from the interior of containers;

said second controlled gas path is configured to permit solely evacuation of gas from the interior of containers;

in the second, controlled gas path there is at least one valve that regulates the flow, and that opens when there is gas pressure in the gas duct or in the container above atmospheric pressure, and closes at a gas pressure that is equal to or approximately equal to atmospheric pressure;

the valve has a valve body that is: biased by a spring against a valve seat, or in contact against a valve surface by its dead weight; and the second controlled gas path has at least one control valve, and that control means are provided that automatically open the control valve for the pressure relief and automatically close the control valve after a specified pressure relief time.

17. The filling element according to claim 16, wherein:

the pressure relief time is adjustable, as a function of the product and/or the type and/or size of the containers;

the filling element comprises a pressure sensor that supplies a control or measurement signal to the control means to control the control valve in the second gas path, which signal corresponds to the pressure in the container or in a gas duct which is in communication with the interior of the container;

the control means close the second control valve when the control signal supplied by the pressure sensor corresponds to the ambient pressure or to approximately the ambient pressure or to a specified setpoint pressure;

the control means determine, as a function of the measurement signal supplied by the pressure sensor, the pressure relief time (TE) required to reduce the pressure to ambient pressure, with which the second gas path or the filling element or of additional filling elements is closed; and its configuration in the form of a filling element without a filler tube with a product dispensing opening on an underside of a filling element housing, and with a gas return duct which, when the container is attached to the filling element, ends in the interior of the container, whereby the second gas path ends via the gas duct into the liquid duct in the vicinity of the product dispensing opening.

18. The filling element according to claim 17 in combination with a filling machine employing a rotary construction for filling a product in bottles, cans or similar containers under counterpressure and with a subsequent pressure relief to ambient pressure, with a plurality of filling elements on a rotor that can be driven so that it rotates around a vertical machine axis.

19. The combination according to claim 18, wherein:

the pressure relief time (TE) can be set or adjusted for all of the filling elements of the filling machine at once; and at least one filling element of the filling machine has a pressure sensor in the pressure relief duct.

20. The combination according to claim 19, wherein:

each of the filling elements of the filling machine has its own pressure sensor in the pressure relief duct;

the pressure relief control system that interacts with the pressure sensor determines the pressure relief time (TE) for the control of the second gas path, with which pressure relief time the pressure relief of all of the filling elements that are associated with the filling element with the pressure sensor is controlled; and only one filling element of the filling machine has the pressure sensor that measures the pressure in the pressure relief duct.

* * * * *

UNITED STATES PATENT AND TRADEMARK OFFICE

CERTIFICATE OF CORRECTION

PATENT NO. : 7,647,950 B2
APPLICATION NO. : 11/451127
DATED : January 19, 2010
INVENTOR(S) : Ludwig Clüsserath It is certified that error appears in the above-identified patent and that said Letters Patent is hereby corrected as shown below:

Column 18, line 20 of Claim 2, after "adjustable" delete ",".

Column 20, line 2 of Claim 7, after "adjustable" delete ",".

Column 21, lines 28 and 29 of Claim 14, after "vacuum" delete "duct filling machine, in which there is and" and substitute -- duct; and --.

Column 22, line 2 of Claim 17, after "adjustable" delete ",".

Signed and Sealed this

Eighteenth Day of May, 2010

David J. Kappos

David J. Kappos
*Director of the United States Patent and Trademark Office*